United States Patent [19]

McLain

[11] 4,120,255

[45] Oct. 17, 1978

[54] MONOFILAMENT SEWING THREAD

[75] Inventor: Philippe Hardy-The McLain, Columbia, S.C.

[73] Assignee: Shakespeare Company, Columbia, S.C.

[21] Appl. No.: 818,518

[22] Filed: Jul. 25, 1977

Related U.S. Application Data

[63] Continuation-in-part of Ser. No. 720,255, Sep. 3, 1976, abandoned.

[51] Int. Cl.[2] ..... D05B 85/00

[52] U.S. Cl. ..... 112/222; 223/102

[58] Field of Search ..... 112/222, 79 R, 410; 2/243 R, 275; 223/103, 102; 128/339, 340

[56] References Cited

U.S. PATENT DOCUMENTS

| | | | |
|---|---|---|---|
| 481,338 | 8/1892 | Weigand | 223/103 |
| 3,397,660 | 8/1968 | Luther | 112/222 |
| 3,607,612 | 9/1971 | Hudson | 161/181 |
| 3,630,816 | 12/1971 | Parker | 161/72 |
| 3,812,799 | 5/1974 | Spanel | 112/79 R |

*Primary Examiner*—George H. Krizmanich

*Attorney, Agent, or Firm*—Hamilton, Renner & Kenner

[57] ABSTRACT

Disclosed is a novel combination of a sewing machine needle having a rectangular eye and a monofilament sewing thread of a synthetic material having a width to thickness ratio of approximately 3.0:1 to about 4.0:1.

6 Claims, 6 Drawing Figures

MONOFILAMENT SEWING THREAD

CROSS REFERENCE TO RELATED APPLICATION

This application is a continuation-in-part of my copending application Ser. No. 720,255, filed Sept. 3, 1976, now abandoned.

BACKGROUND OF THE INVENTION

The present invention relates to a novel syntehtic monofilament thread conventionally employed in sewing operations. The synthetic material most commonly employed is nylon and as such, monofilament threads have been utilized commercially for approximately ten years for a variety of sewing operations ranging from the clothing industry to the heavier duty upholstery, furniture and industrial fabrics. Irrespective of the industry and its product, all share in common the joining of two or more layers of fabric with a sewing machine generally including a thread let-off mechanism, a needle and a bobbin mechanism.

One of the reasons nylon monofilament threads are specified rather than the older, standard natural fibers, e.g., cotton, is due to the far superior tensile strength of nylon over natural fibers. In addition to the greater strength initially, nylon tends to have a greater life; being moisture and air resistant, it weathers far better than cotton. The fact that nylon monofilament thread is transparent, substantially eliminating the need for dyeing and keeping large quantities of thread merely to be able to match various fabrics, has further added to its acceptance and desirability over the natural materials.

Notwithstanding the advantages attendant nylon monofilament, the thread is not entirely free from problems and criticism. One of the chief problems encountered is, as the thread is employed with heavier materials, e.g., denim, cotton duck, seat cushions, foam backing, vinyls, and the like, it tends to melt forming a break in the line or a condition known as burn-off. The melting or burn-off is of course due to friction which becomes a problem as thread diameters are increased, particularly beyond 7.0 mils (0.0178 cm) and increasingly more so at diameters of 10.0 mils (0.0254 cm) and greater. For such applications heavier equipment is employed which includes larger needles.

The larger needle becomes quite hot due not only to the friction encountered between its eye and the thread, but also due to the greater resistance it encounters during repeated penetration of the work fabric. The greater tension on the thread also causes friction with resultant heat increases between the thread and the discs. When the heat of friction becomes great enough, one of several things may happen resulting in burn-off or breakage. First, the thread can melt at a point of contact with any of the hot surfaces either during movement of the thread or, more likely, during a pause when it may then stick to the needle. Second, the thread can abrade as it passes over and through the various machine components weakening the thread until it breaks as well as generating heat for a subsequent burn-off. Third, excessive heat can elevate the temperature of the monofilament thread to a point just below its melt at which it will elongate, reducing its cross-sectional area and tensile strength until breakage occurs.

Whenever burn-off or breakage occurs, sewing ceases and rethreading operations commence with an expenditure of time and as much as 20 inches (50.8 cm) of thread in waste. It is not uncommon for a breakage to be experienced with every several inches (cm) of thread sewn making such operations troublesome and unprofitable.

In some instances the thread may not melt through or break, but enough heat is generated for it to stick to the eye of the needle and perhaps the discs. If the thread cannot pass freely through the eye of the needle or its movement is excessively impeded by the discs, skipped stitches can result. When the needle and thread pass through the work fabric a loop should be formed to be united with the bobbin thread. Skipped stitches occur if the thread is sticking to an extent that a loop is not formed at all or is insufficient to be caught by the bobbin thread. At this point, an interruption to free the sticking may allow another hot surface to melt through the thread as discussed previously.

Still another problem encountered with nylon monofilament thread is slipback. Usually, when a seam is started a lock stitch or back stitch is made by running the needle and thread in one spot or backover the first several stitches. However, if the lock or back stitch is not employed because of time and/or appearance considerations, and a seam is sewn in the forward direction, even the least amount of force subsequently applied to the beginning will cause the seam to open due to the inherent stiffness of any synthetic round thread with itself and the fabric through which it passes.

Synthetic threads also tend to be considerably more stiff than the natural fibers and therefore, exposed ends can be sharp to the touch — an undesirable property when such threads contact the body. Although the exposed ends are seldom injurious to a person, the occasional discomfort caused thereby is annoying.

Finally, from an aesthetic consideration, synthetic round monofilament threads, albeit transparent, reflect light from many angles to a degree that their visibility can detract from the appearance of the fabric or article sewn with such thread. These threads, being round in cross-section and inherently stiff, often do not form close lying seams but rather raised loops above the material not only visible, but also sufficiently exposed to be picked or snagged. Also, for a stitch to be attractive, its optimum formation occurs when the interlocking loop, made by joining the top and bobbin thread, is interposed between the two pieces of fabric and not when the loop of one side is pulled through to the opposite fabric piece. Round synthetic monofilament threads often do not form flat, smooth stitches. This is particularly true when abrasion and heat cause the thread to drag, interferring with the sewing operation. p Although not immediately apparent, one possible reason for all the problems experienced with synthetic monofilament threads is their cylindrical configuration. However, with the exception of the existent multifilament synthetic threads commerically available which are free from some of the problems discussed herein, little success has been made toward satisfactorily improving the sewability of the monofilament threads in spite of considerable activity in this field. Eight U.S. patents which typify various attempts to produce synthetic monofilament thread having different cross-sectional profiles are U.S. Pat. Nos. 1,773,969; 2,816,349; 2,953,839; 3,156,607; 3,298,169; 3,425,893; 3,673,053; and, 3,802,177. While it is not known how satisfactorily these threads may be sewn, several of the patents are directed toward configurations designed to control stiffness and reflectivity. However, none is addressed toward nor discusses the problems of burn-off, skipped stitch, slipback and the like, presented hereinabove.

SUMMARY OF THE INVENTION

It is therefore an object of the present invention to provide a synthetic monofilament thread which can be sewn at normal operating speeds for considerable distances through a variety of fabrics without burn-off, sticking of the thread to sewing machine components, or elongation of the thread.

It is another object of the present invention to provide a synthetic monofilament thread which does not produce skipped stitches or slipback and which is considerably less stiff and reflective of light than known synthetic monofilaments having a round cross-section and which can sew a most acceptable stitch in terms of both strength and appearance.

It is yet another object of the present invention to provide a synthetic monofilament thread capable of meeting all of the foregoing objects and yet having but a single non-cylindrical configuration.

These and other objects of the present invention, together with the advantages thereof over existing and prior art forms, which shall become apparent from the specification which follows, are accomplished by means hereinafter described and claimed.

In general, the novel sewing thread of the present invention comprises a synthetic monofilament strand having a width to thickness ratio of from about 3.0:1 to about 4.0:1 and preferred dimension of from 6.0 to about 17.5 mils (0.015 to 0.445 cm) width and from 1.8 to about 4.5 mils (0.0045 to 0.0114 cm) thickness. Suitable synthetic materials include polyesters, polyethylene, polypropylene, nylon and the like with nylon filament being exemplified hereinbelow.

DETAILED DESCRIPTION OF THE PREFERRED EMBODIMENT

Figure 1:
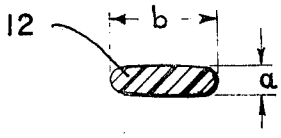
FIG. 1 illustrates the cross-section of the novel monofilament thread of the present invention.
Figure 2:
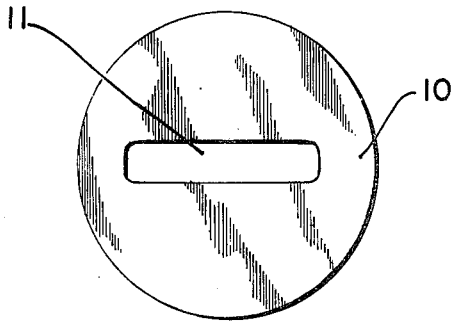
FIG. 2 illustrates the die through which the synthetic material is drawn to form the thread of the present invention.

The preferred synthetic monofilament thread of the present invention is nylon and is formed in a conventional maner by extrusion of the molten polymer through a plurality of spinnerets such as the spinneret 10 in FIG. 2. The orifice 11 of spinneret 10 has a slotted shape 18 mils high and 94 mils wide. The monofilament thread 12, depicted in FIG. 1, has been drawn subsequent to extrusion until it has been elongated approximately five times and has a width *a*, of 17.5 mils (0.445 cm) and thickness *b*, of 4.5 mils (0.0114 cm). While the effective width to thickness ratio of the resultant thread 12 is 3.89:1, it is believed that ratios of approximately 3.5:1 to 4.0:1 are acceptable to meet the objects of the present invention. As stated hereinabove, thread widths may vary from 6.0 to about 17.5 mils (0.015 to 0.445 cm) and thicknesses from 1.8 to about 4.5 mils (0.0045 to 0.0114 cm). Suitable combinations of the widths and thicknesses may be determined by maintaining their ratios between 3.0:1 and 4.0:1.

The non-circular cross-sectional profile of the filament 12 may be generally considered as rectangular and the thread therefore thought of as flat. In order to determine the effectiveness of the flat thread 12 versus the standard round, circular cross-sectional profile thread, seams were sewn with both and compared as to length of the seam prior to burn-off and the detection of skipped stitches. Dimensions of the flat thread were as described above while the round thread had a diameter of 10 mils (0.0254 cm). The denier of the flat thread was 505 while that of the round thread was 520. Both flat and round threads employed were manufactured by Shakespeare Monofilament Division, a division of Shakespeare Company, the Assignee of record herein.

The material sewn with the threads was 7 ounce (198 gm) drill. A Union Special 62,200 GAZ heavy-duty lockstitch machine was employed, operated at a speed of 4000 rpm. The bobbin thread was a conventional nylon multifilament. With the round thread, sticking to the needle and burn-off was observed after only 38 inches (96.5 cm) of sewing and, in this distance eight skipped stitches were observed. When the flat thread was employed, there was no sticking to the needle or burn-off after 22 yards 20.1 M) of sewing, the length at which the bobbin ran out of thread, nor were any skipped stitches observed.

The stiffness of the flat thread is physically observable as one-third to about one-half that of the round thread. It may be demonstrated to be about one-fourth as stiff mathematically by calculation of a stiffness factor EI where E is the modulus of elasticity, and I is the moment of inertia, of the material. Inasmuch as the threads are identical in composition, the modulus of elasticity is the same and so E may be ignored with the stiffness varying in direct proportion to the moment of inertia. The moment of inertia of a round cylinder is $d^4 \times 0.0495$. For a 10 mil (0.0254 cm) thread, this value is 495 mils (1.257 cm) to the fourth power. While for a flat thread 4.5 mils (0.0114 cm) thick $\times$ 17.5 mils (0.445 cm) wide, the figure is 133 mils (0.338 cm) to the fourth power. Significantly, the areas of each were nearly identical — 78.54 mils$^2$ ($5.0670 \times 10^{-4}$ cm$^2$) for the round thread and 78.75 mils$^2$ ($5.0806 \times 10^{-4}$ cm$^2$) for the flat thread.

Upon further physical testing and observation it has been found that the flat thread produced a better looking seam having a well-defined top stitch on the upper fabric and bottom stitch on the lower fabric. Neither stitch had been pulled through and exposed on the opposite side. Owing to the flattness of the thread, the seam laid closer to the fabric minimizing the chances of snagging. Because round threads reflect light from all directions, reflectivity of the flat thread was observed to be less than that exhibited by the round, resulting in a less visible seam. Skipped stitches and slipback were also virtually eliminated where the flat thread was employed.

Figure 3:
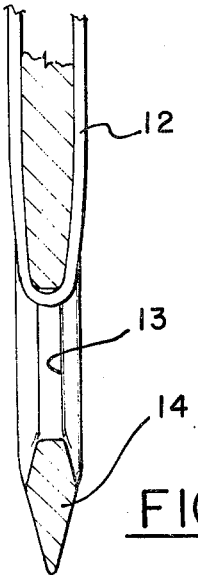
FIGS. 3 and 4 illustrate a typical sewing needle and the thread of the present invention passing therethrough; and, FIGS. 5 and 6 illustrate a typical sewing needle and a conventional round thread passing therethrough.
Figure 5:
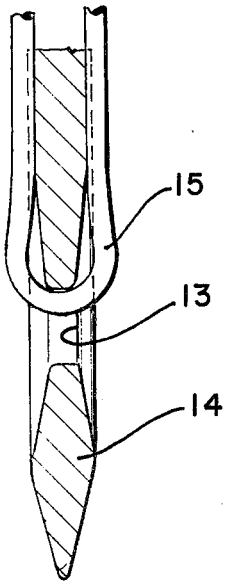
Figure 6:
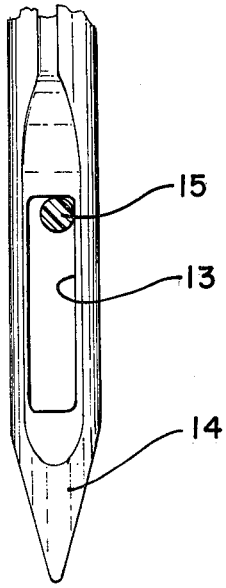

Another advantage of the flat thread is that its softness or low moment of inertia allows it to flex more readily and, the lay-up against both edges of the needle is more flat so that the total thickness of the needle and thread passing through the fabric is less than when a round thread of equivalent strength is employed. With reference to FIG. 3, the filament 12 has been drawn through the eye 13 of a sewing needle 14. When the needle is passed through the fabric, it draws with it two lengths of thread, one on either side thereof. However, the combined thickness of both threads, *2a*, is only 9 mils (0.0228 cm), or less than a single strand of the 10 mil (0.0254 cm) diameter round monofilament thread 15 of FIG. 5, which is of course itself doubled when sewn.

Figure 4:
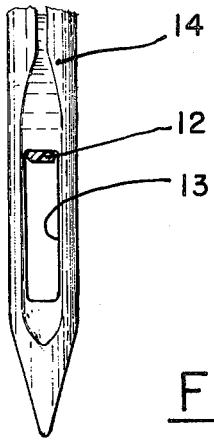

The flatter profile of the thread 12 compared with that of the round thread 15 is also depicted in FIGS. 3 and 4 and is attributed to dimensions of the thread 12 and its lower stiffness. In FIG. 3, it is seen that the thread 12 is less likely to disturb the fabric through which it passes than the round thread 15 which does not readily adapt the slender profile of the needle 14. Thus, far less resistance is encountered by the fabric which receives the flat thread 12 than the round thread 15 resulting in less friction, heat and abrasion.

Another advantage of the flat thread 12 is its greater surface area which allows more surface to carry a lubrication finish when one is to be employed. Its profile also provides a larger contact with the eye of the needle 14, as depicted in FIG. 4, than the tangential contact of the round thread 15 with the needle eye 13. When a lubricant is employed with the round thread 15, it is quickly rubbed off at two points where it tangentially contacts the needle eye 13 while on the flat thread 12, a large area of lubricating film contacts the needle eye 13. For these reasons it may be understood that the flat thread of the present invention will run much cooler through sewing machines substantially reducing the problem of burn-off and other problems attendant friction, abrasion and heat increases.

Thus, it should be apparent from the foregoing description of the preferred embodiment that the present invention accomplishes the objects of the invention. As will be apparent to those skilled in the art, variations of the foregoing description may be made without departing from the spirit of the invention herein disclosed and described. The scope of the invention being limited solely by the scope of the attached claims.

I claim:

1. In combination with a sewing machine needle having a rectangular eye elongated axially thereof, a synthetic monofilament sewing thread of substantially rectangular cross section having a width to thickness ratio of about 3.0:1 to about 4.0:1, said thread adapted to lie flatwise against the inner end of said eye when passing through said eye during a stitching operation.

2. In combination with a sewing machine needle having a rectangular eye elongated axially thereof as defined in claim 1, wherein said thread width is substantially equal to the width of said eye.

3. In combination with a sewing machine needle having a rectangular eye elongated axially thereof as defined in claim 1, in which the monofilament sewing thread is nylon.

4. In combination with a sewing machine needle having a rectangular eye elongated axially thereof as defined in claim 2, in which the monofilament sewing thread is nylon.

5. In combination with a sewing machine needle having a rectangular eye elongated axially thereof as defined in claim 1, in which the monofilament sewing thread has a width of from 6.0 to about 17.5 mils (0.015 to 0.445 cm) and a thickness of from 1.8 to about 4.5 mils (0.0045 to 0.0114 cm).

6. In combination with a sewing machine needle having a rectangular eye elongated axially thereof as defined in claim 2, in which the monofilament sewing thread has a width of from 6.0 to about 17.5 mils (0.015 to 0.445 cm) and a thickness of from 1.8 to about 4.5 mils (0.0045 to 0.0114 cm).

* * * * *